US007641570B2

(12) United States Patent
Yokota

(10) Patent No.: US 7,641,570 B2
(45) Date of Patent: Jan. 5, 2010

(54) GOLF CLUB HEAD

(75) Inventor: Masatoshi Yokota, Kobe (JP)

(73) Assignee: SRI Sports Limited, Kobe (JP)

( * ) Notice: Subject to any disclaimer, the term of this patent is extended or adjusted under 35 U.S.C. 154(b) by 147 days.

(21) Appl. No.: 12/010,859

(22) Filed: Jan. 30, 2008

(65) Prior Publication Data

US 2008/0254910 A1 Oct. 16, 2008

(30) Foreign Application Priority Data

Apr. 10, 2007 (JP) ..... 2007-103076

(51) Int. Cl.
*A63B 53/04* (2006.01)

(52) U.S. Cl. ..... 473/331; 473/330

(58) Field of Classification Search ..... 473/324–350
See application file for complete search history.

(56) References Cited

U.S. PATENT DOCUMENTS

| | | | | | |
|---|---|---|---|---|---|
| 1,337,958 | A * | 4/1920 | Reach | 473/331 |
| D55,278 | S * | 5/1920 | Kraeuter | D21/750 |
| 4,508,349 | A * | 4/1985 | Gebauer et al. | 473/330 |
| 5,681,228 | A * | 10/1997 | Mikame et al. | 473/330 |
| 6,139,445 | A * | 10/2000 | Werner et al. | 473/330 |
| 6,267,690 | B1 * | 7/2001 | Salmon | 473/325 |
| 6,299,548 | B1 * | 10/2001 | Lin | 473/331 |
| 6,309,310 | B1 * | 10/2001 | Shira | 473/331 |
| 6,348,010 | B1 * | 2/2002 | Doolen | 473/290 |
| 2001/0000170 | A1 * | 4/2001 | Doolen | 473/331 |
| 2002/0002084 | A1 * | 1/2002 | Miyamoto | 473/330 |
| 2008/0254910 | A1 * | 10/2008 | Yokota | 473/331 |

FOREIGN PATENT DOCUMENTS

| | | | |
|---|---|---|---|
| JP | 60-88568 | A | 5/1985 |
| JP | 02005980 | A * | 1/1990 |
| JP | 08206259 | A * | 8/1996 |
| JP | 09299518 | A * | 11/1997 |
| JP | 10248976 | A * | 9/1998 |
| JP | 2001062007 | A * | 3/2001 |
| JP | 2001137394 | A * | 5/2001 |
| JP | 2001137397 | A * | 5/2001 |
| JP | 2004008303 | A * | 1/2004 |
| JP | 2004049802 | A * | 2/2004 |
| JP | 2008259582 | A * | 10/2008 |

* cited by examiner

*Primary Examiner*—Alvin A Hunter
(74) *Attorney, Agent, or Firm*—Birch, Stewart, Kolasch & Birch, LLP

(57) ABSTRACT

A golf club head comprises a face portion whose front face forms a clubface having a clubface roll of a radius R, and the clubface is provided with a plurality of parallel grooves extending straight at an angle of not more than 10 degrees with respect to the toe-and-heel direction of the head so as to form at least one lateral zone between the parallel grooves, wherein the above-mentioned at least one lateral zone is provided with a convex curve of a radius (r) smaller than the radius R of the clubface roll.

6 Claims, 6 Drawing Sheets

GOLF CLUB HEAD

BACKGROUND OF THE INVENTION

The present invention relates to a golf club head, more particularly to a structure of the clubface.

In general, a wood-type golf club head has a clubface provided with a bulge (a curvature from heel to toe) and a roll (a curvature from crown to sole).

Such clubface roll has a function to decrease the difference in the backspin of the hit ball between the on-center shot (at the sweet spot) and vertically off-center shots (on the upside or downside of the sweet spot) as well-known in the art. If there is no roll namely the clubface is flat, then due to the so called vertical gear effect, the backspin is decreased in the case of upper shots, but in the case of lower shots, the backspin is increased. Thus, depending on the ball hitting position, the backspin varies widely. By providing a clubface roll, however, the gear effect is lessened and the variation of the backspin is reduced although the backspin in the on-center shot is still more than that in the upper shot and less than that in the lower shot due to the gear effect.

Further, in the case of the upper shot, the clubface roll can increase the launch angle of the hit ball, and thus compensate a decrease in the ballistic height due to the decrease in the backspin from that in the on-center shot.

In the case of the lower shot, on the other hand, the clubface roll can decrease the launch angle of the ball, and compensate an increase in the ballistic height due to the increase in the backspin from that in the on-center shot.

Thus, the difference in the backspin between the on-center shot and vertically off-center shots can be reduced.

On the other hand, the clubface is provided with grooves in a pattern so called score lines. If there is no groove, the frictional force between the clubface and the ball at impact is reduced, and the backspin is lessened. As a result, it becomes difficult to obtain the necessary backspin in a wet condition and the hit ball drops early from the sky, largely loosing the carry distance. By providing the grooves, the friction between the clubface and ball is increased, and the lack of backspin in the wet conditions can be prevented and the loss of the carry distance is decreased. But, in the dry conditions, due to the increased friction between the clubface and ball, the above-mentioned vertical gear effect has a tendency to increase, and as a result, the difference in the backspin between the on-center shot and vertically off-center shots has a tendency to increase again although the clubface roll is provided.

SUMMARY OF THE INVENTION

It is therefore, an object of the present invention to provide a golf club head which can reduce the variation of the backspin due to the variation of the ball hitting position as well as the difference between the wet and dry conditions in order to avoid undesirable early dropping or rising of the golf ball and thereby the loss of the carry distance is reduced.

According to the present invention, a golf club head comprises a face portion whose front face forms a clubface having a clubface roll of a radius R, the clubface provided with a plurality of parallel grooves extending straight at an angle of not more than 10 degrees with respect to the toe-and-heel direction of the head so as to form at least one lateral zone between the parallel grooves, wherein the above-mentioned at least one lateral zone is provided with a convex curve of a radius (r) smaller than the radius R of the clubface roll.

The convex curve can be provided on the lateral zone at the sweet spot and the lateral zones near the sweet spot. Further, the convex curve can be provided on a part of the lateral zone which part is near the sweet spot or includes the sweet spot.

In this specification, the dimensions, positions and directions refer to those under the standard state of the club head unless otherwise noted.

The standard state of the club head is such that the club head is set on a horizontal plane HP so that the axis CL of the clubshaft (or the shaft inserting hole 7*a* of the hosel) is inclined at the lie angle alpha while keeping the axis on a vertical plane VP, and the clubface 2 at the sweet spot SS forms its loft angle beta with respect to the horizontal plane HP.

The toe-and-heel direction TH is a horizontal direction parallel to the vertical plane VP.

The crown-and-sole direction is a vertical direction perpendicular to the horizontal plane HP.

The sweet spot SS is the point of intersection between the clubface 2 and a straight line N drawn normally to the clubface from the center of gravity G of the head.

The front view means a view perpendicular to the vertical plane VP.

DESCRIPTION OF THE PREFERRED EMBODIMENTS

Figure 1:
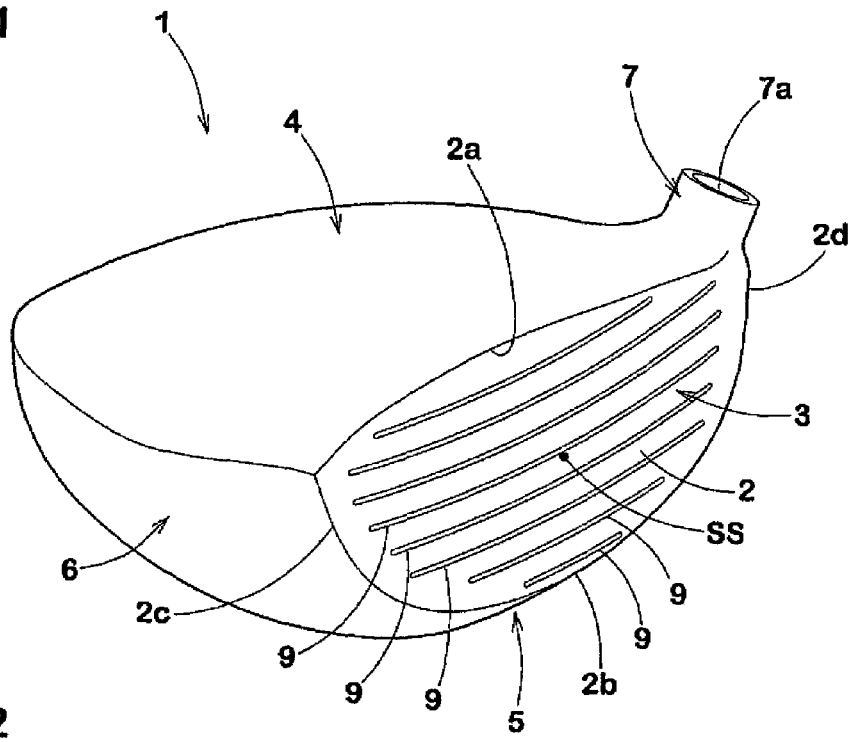
FIG. 1 is a perspective view of a wood-type golf club head according to the present invention.

Embodiments of the present invention will now be described in detail in conjunction with accompanying drawings.

In the drawings, golf club head 1 according to the present invention is a hollow head for a wood-type golf club such as driver (#1) or fairway wood.

The head 1 comprises: a face portion 3 whose front face defines a clubface 2 for hitting a ball; a crown portion 4 intersecting the clubface 2 at the upper edge 2*a* thereof; a sole portion 5 intersecting the clubface 2 at the lower edge 2*b* thereof; a side portion 6 between the crown portion 4 and sole portion 5 which extends from a toe-side edge 2*c* to a heel-side edge 2*d* of the clubface 2 through the back face BF of the club head; and a hosel portion 7 at the heel-side end of the crown to be attached to an end of a club shaft (not shown) inserted into the shaft inserting hole 7*a*. In this embodiment, the club head 1 has a shell structure with the thin wall and a hollow (i) behind the face portion 3.

In order to reduce the weight of the club head 1, a fiber reinforced resin may be used to form a part of the head 1. But, in this embodiment, the head 1 is made of one or more kinds of metal materials having large specific tensile strength. Specifically, stainless steels, maraging steels, pure titanium, titanium alloys, magnesium alloys, aluminum alloys can be preferably used. AS to the titanium alloys, Ti-6Al-4V, Ti-15V-3Cr-3Al-3Sn, Ti-15Mo-5Zr-3Al, Ti-13V-11Cr-3Al and the like can be preferably used.

If the size of the clubface 2 is too small in the crown-and-sole direction, the rebound performance is deteriorated to decrease the carry distance, and it becomes difficult to address the ball. If too large, on the other hand, there is a possibility that the position of the sweet spot SS becomes high. Thus the carry distance is decreased.

Figure 5:
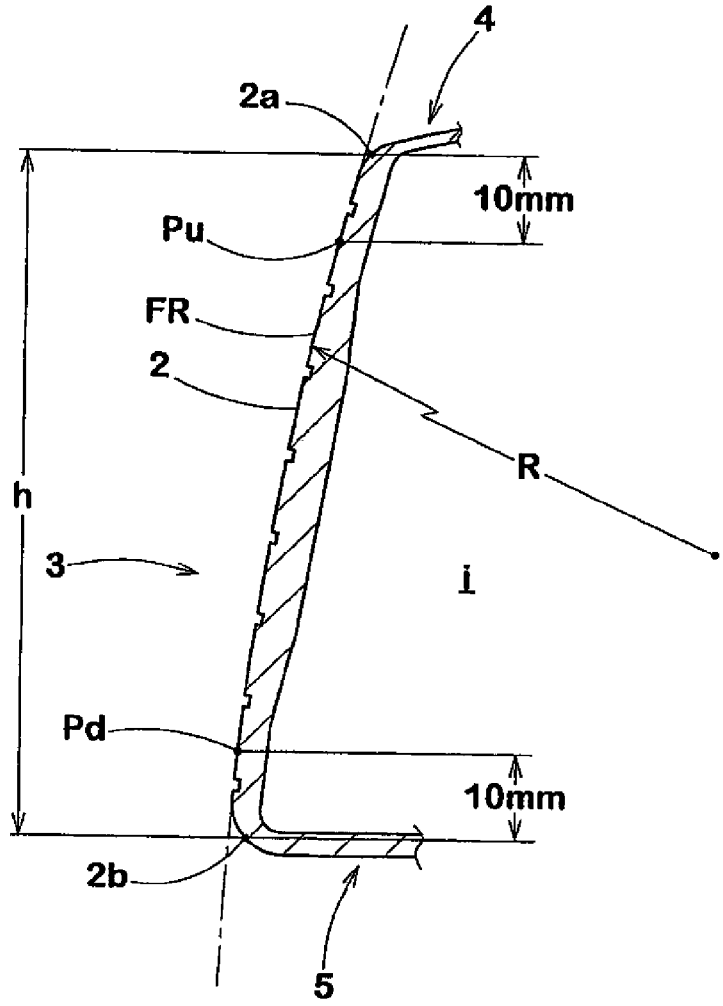
FIG. 5 is a cross sectional view for explaining the radius of the clubface roll.

Therefore, the height h of the clubface 2 is set in a range of not less than 30 mm, preferably not less than 35 mm, more preferably not less than 40 mm, but not more than 70 mm, preferably not more than 65 mm, more preferably not more than 60 mm, when measured vertically from the lower edge 2*b* to the upper edge 2*a* in the vertical cross section including the center G of gravity and the sweet spot SS as shown in FIG. 5.

Figure 2:
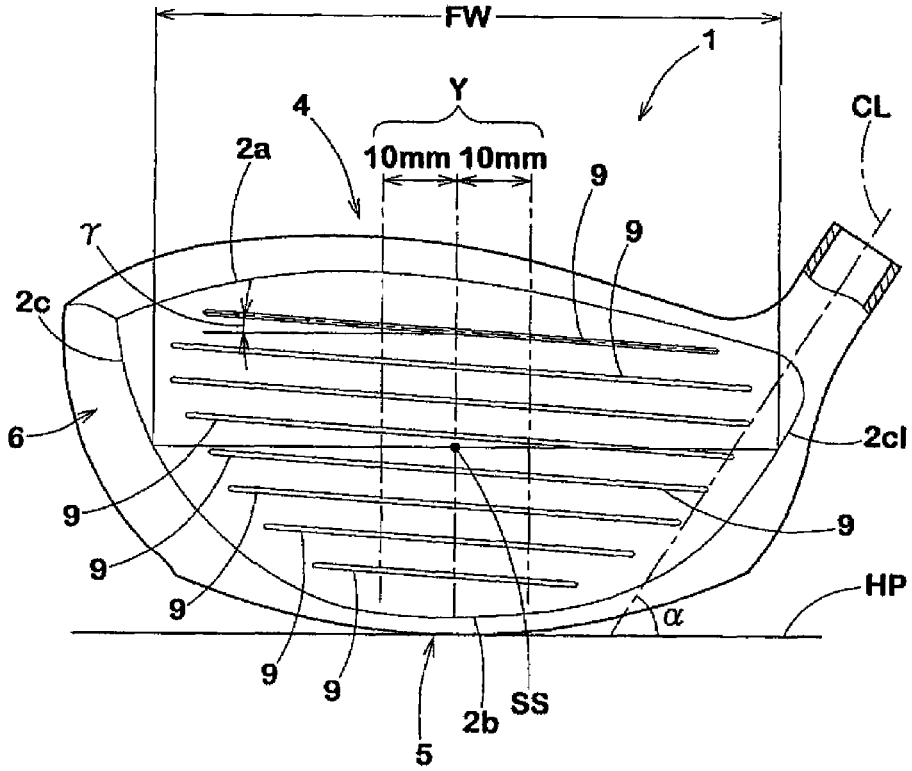
FIG. 2 is a front view thereof.
Figure 3:
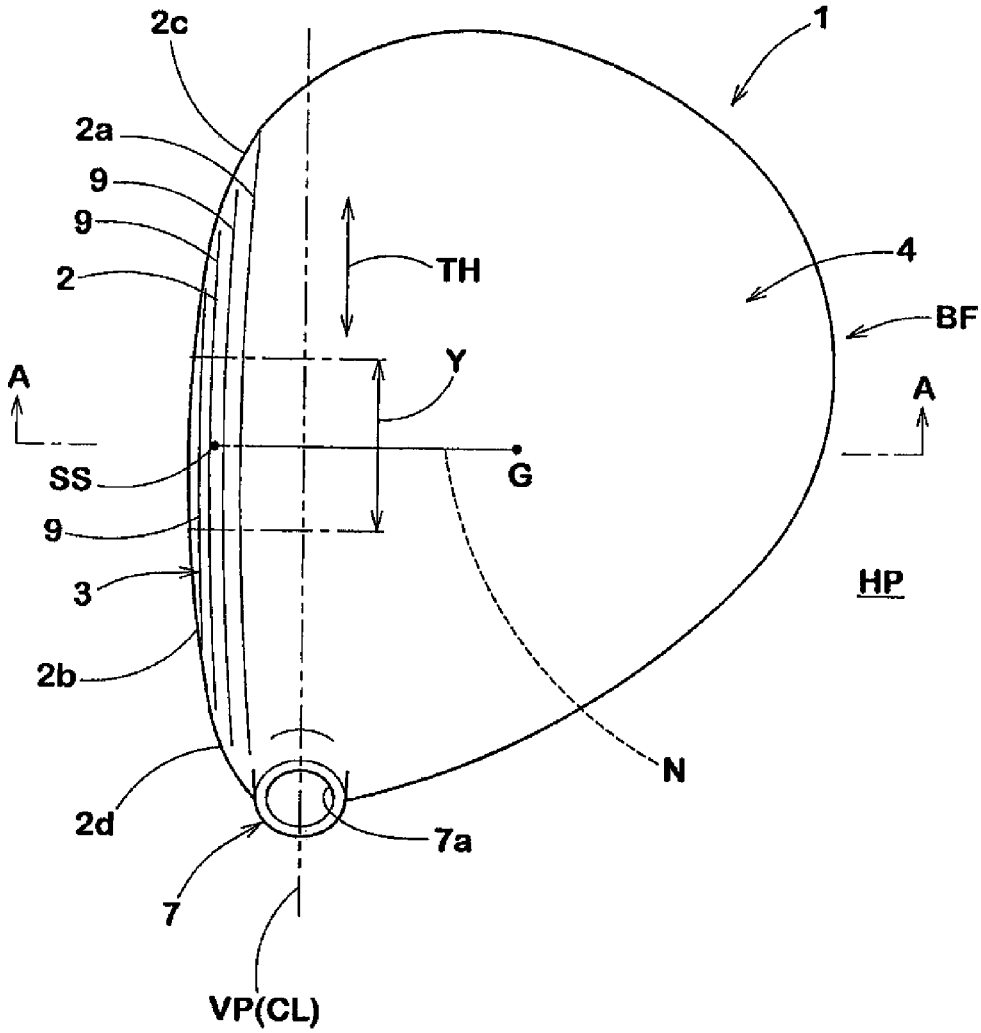
FIG. 3 is a top view thereof.

As to the width FW of the clubface 2, on the other hand, in order to make it easy or assured to address the ball and also achieve a suitable weight distribution, the width FW is preferably set in a range of not less than 90 mm, more preferably not less than 95 mm, still more preferably not less than 100 mm, but not more than 130 mm, more preferably not more than 127 mm, still more preferably not more than 125 mm, when measured horizontally from the toe-side edge 2*c* to the heel-side edge 2*d* passing through the sweet spot SS as shown in FIG. 2.

If the edge (2*a*, 2*b*, 2*c*, 2*d*) of the clubface 2 is unclear due to smooth change in its curvature, a virtual edge which is defined, based on the curvature change, is used instead as follows: In the vertical cross section including the sweet spot SS and the center G of gravity, the edge is defined as a point at which the radius of curvature of the profile line of the face portion 3 first becomes 20 mm in the course from a point on the clubface in its peripheral part toward the adjacent portion such as the crown portion, sole portion and side portion.

Further, the clubface 2 is provided with a roll FR as usual.

If the radius R of the clubface roll FR becomes too small, then in the case of upper shots, the ball launch angle is excessively increased and the loss of the carry distance increases. In the case of lower shots, on the other hand, the launch angle is excessively decreased and the carry distance decreases. If the radius R becomes too large, then the vertical gear effect is increased too much, therefor, in the case of upper shots, the backspin becomes insufficient and the hit ball is liable to drop early. In the case of lower shots, the backspin becomes too much and the hit ball tends to undesirably rise. Thus, in either case, the carry distance is decreased.

Figure 4:
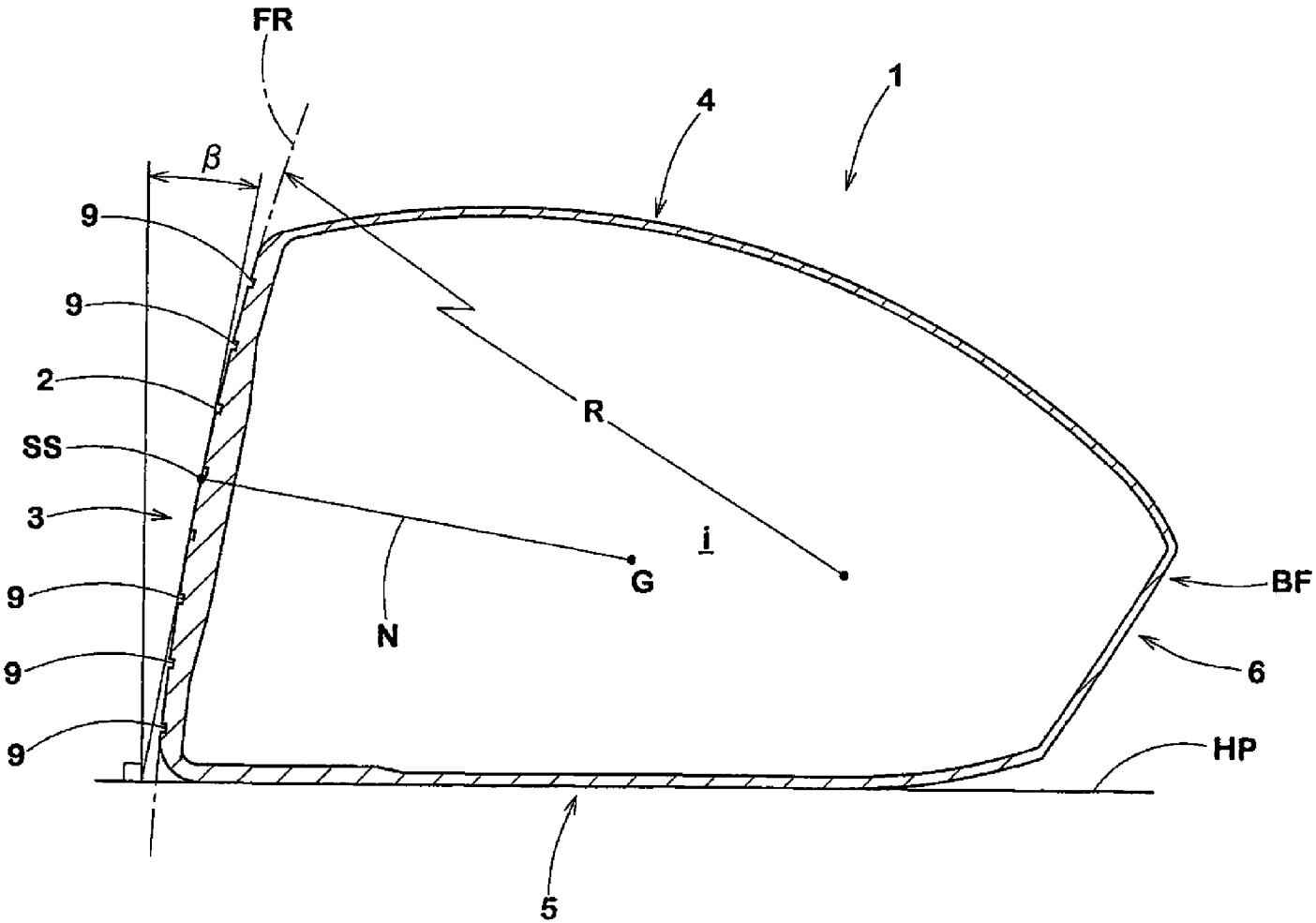
FIG. 4 is a cross sectional view of the head taken along line A-A in FIG. 3.

Therefore, the radius R of the clubface roll FR is preferably set in a range of not less than 120 mm, more preferably not less than 150 mm, still more preferably not less than 200 mm, but not more than 430 mm, more preferably not more than 380 mm, still more preferably not more than 330 mm, when measured in the vertical plane including the center G of gravity and the sweet spot SS as shown in FIG. 4.

Here, the radius R of the clubface roll FR is defined as of a circle passing through-three points on the clubface 2 which are the sweet spot SS, an upper point Pu 10 mm downward from the upper edge 2*a* and a lower point Pd 10 mm upward from the lower edge 2*b* of the clubface 2. If the point (Pu, Pd, SS) becomes positioned within the width of the undermentioned groove 9 or within a range of 0 to 1 mm from the groove edge 9*e* in the vertical direction, then the point is shifted to the nearest position at 1 mm distance from the groove edge 9*e*.

In this embodiment, the profile line from the upper point Pu to the lower point Pd is a circular arc having the single radius R.

The clubface 2 is provided with parallel grooves 9 so called score lines or marking, thereby the clubface 2 is divided into lateral zones 10 between the grooves 9.

The width and depth of the grooves 9 and the intervals therebetween have to determined in compliance with a golf rule. But, preferably, the width is set in a range of from 0.3 to 0.9 mm, and the groove depth is set in a range of from 0.05 to 0.5 mm. The intervals are not less than 3 mm, preferably not less than 5 mm, but preferably not more than 10 mm, more preferably not more than 8 mm, when measured vertically in the vertical cross section including the sweet spot SS and the center G of gravity. In this embodiment, the values of the intervals are substantially constant.

As shown in FIG. 2, in the front view of the head 1, the grooves 9 extend straight at an angle gamma of not more than 10 degrees with respect to the toe-and-heel direction TH.

In the case of the angle gamma being more than zero, it is preferable that the grooves 9 are inclined downwardly from the toe towards the heel.

The number of the grooves 9 is preferably not less than 5, more preferably not less than 6, still more preferably not less than 7. In this embodiment, the number is 8.

All the grooves 9 may be the same length. But, in this embodiment, each of the grooves 9 extends continuously from the vicinity of the toe-side edge 2*c* to the vicinity of the heel-side edge 2*d* across the almost entire width of the clubface 2. Thus, the grooves 9 have different lengths.

As to the cross sectional shape of the groove 9, various shapes, e.g. rectangle, trapezoid, triangle or V-shape, U-shape, etc. can be used.

In the vertical cross section including the sweet spot SS and the center G of gravity, as shown in FIG. 4, all of the grooves 9 (namely, in this embodiment, the eight grooves) appear, and the lateral zones 10 are each provided with a convex curve having a radius (r) less than the radius R of the clubface roll FR.

Figure 6:
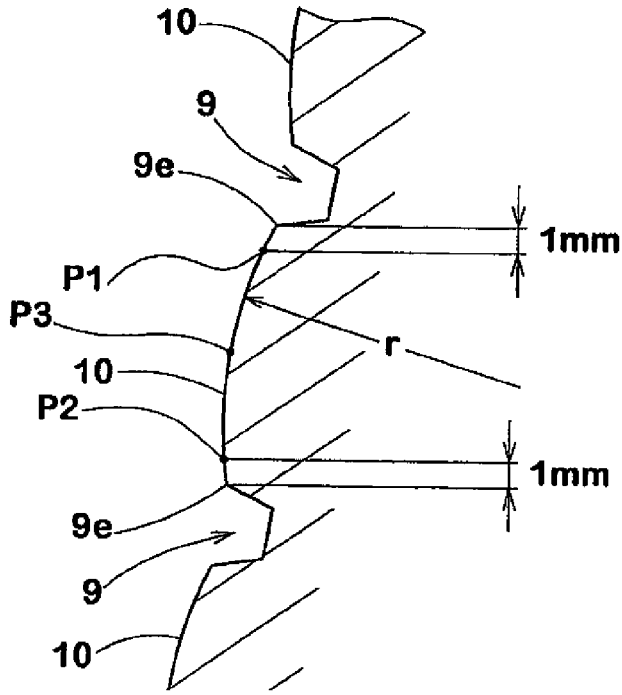
FIG. 6 is a schematic cross sectional view for explaining the radius of curvature of the lateral zone.

Here, the radius (r) of the convex curve is defined as of a circle passing through three points P1, P2 and P3 on the clubface. AS shown in FIG. 6, the points P1 and P2 are 1 mm inside of the respective edges 9*e* of the groove 9, and the point P3 is the midpoint therebetween. The edges 9*e* of the groove 9 can be defined using the 30 degree method of measurement provided by the R&A.

In this embodiment, at least the part between the points P1 and P2 is a circular arc having the single radius (r).

The radius (r) is defined in relation to the radius R of the clubface roll FR. If the ratio (r/R) is excessively decreased, there is a possibility that the backspin becomes insufficient. If the ratio (r/R) is excessively increased, it is difficult to obtain the advantageous effects of the present invention.

Therefore, the ratio (r/R) is preferably set in a range of not less than 0.30, more preferably not less than 0.35, still more preferably not less than 0.40, but, not more than 0.80, more preferably not more than 0.70, still more preferably not more than 0.60.

By setting the ratio (r/R) as above, the contact pressure between the clubface and the ball at impact becomes decreased in the vicinity x of the grooves. Accordingly, the total frictional force which the ball (b) receives, can be decreased. Therefore, in the dry conditions, the above-mentioned increase in the backspin at the time of lower shots and the above-mentioned decrease in the backspin at the time of upper shots are both reduced. In the wet conditions, on the other hand, due to the convex curve, the water existing between the clubface 2 and ball (b) is effectively dispersed towards the grooves 9, and as a results, a good contact between the ball and clubface like in the dry conditions is assured and the effects similar to those in the dry conditions can be obtained.

Thus, regardless of wet or dry, it is possible to obtain a steady reduced contact between the clubface and the ball, and the difference in the backspin between the on-center shot and vertically off-center shots can be effectively decreased.

In order to certainly decrease the contact pressure in the vicinity x of the grooves 9, the radius (r) is preferably set in a range of not more than 300 mm, more preferably not more than 250 mm, still more preferably not more than 230 mm. However, if the radius (r) becomes excessively decreased, the backspin becomes insufficient, therefore the radius (r) is preferably not less than 50 mm, more preferably not less than 80 mm, still more preferably not less than 100 mm.

In this embodiment, all of the lateral zones 10 are provided with the above-mentioned convex curve of the radius (r), but, this is not always necessary.

Figure 7:
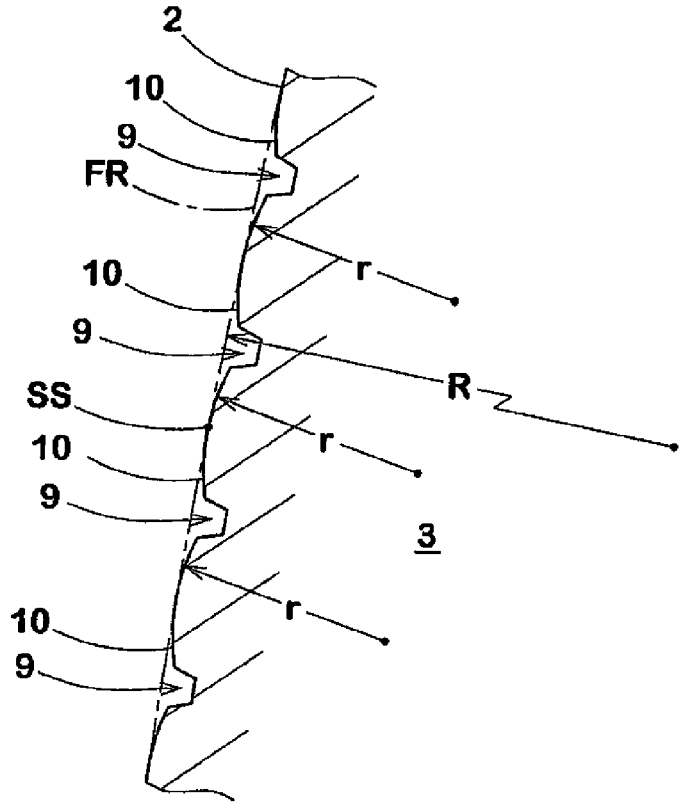
FIG. 7 and FIG. 8 are cross sectional views showing examples of the positional relationship between the sweet spot and the grooves.
Figure 8:
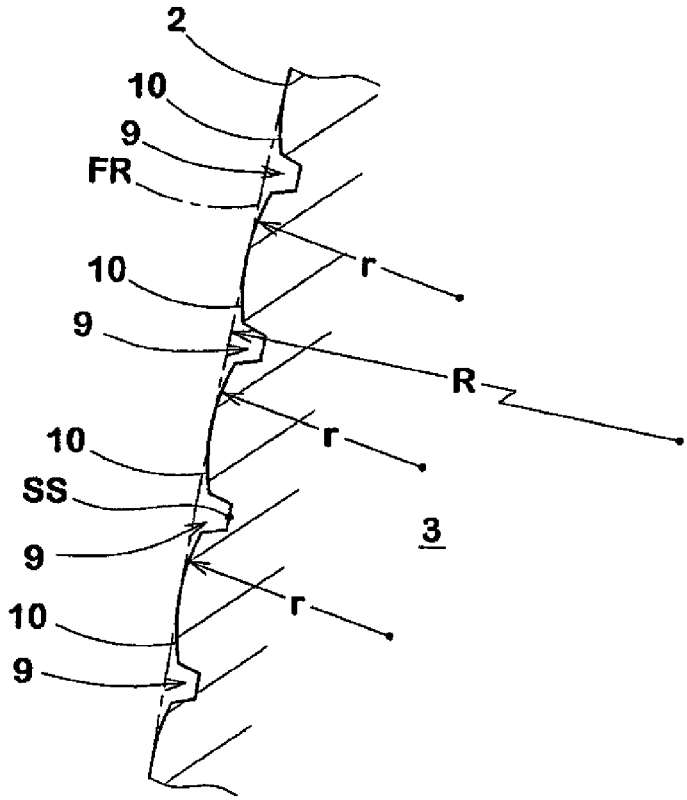
Figure 9:
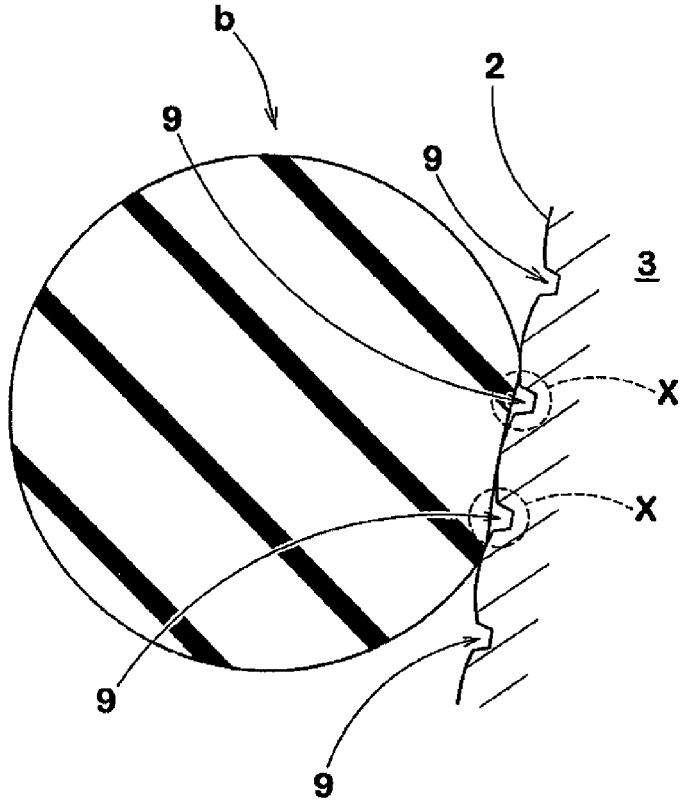
FIG. 9 is a diagrammatic cross sectional view showing the interface of the clubface according to the present invention and a golf ball at impact.
Figure 10:
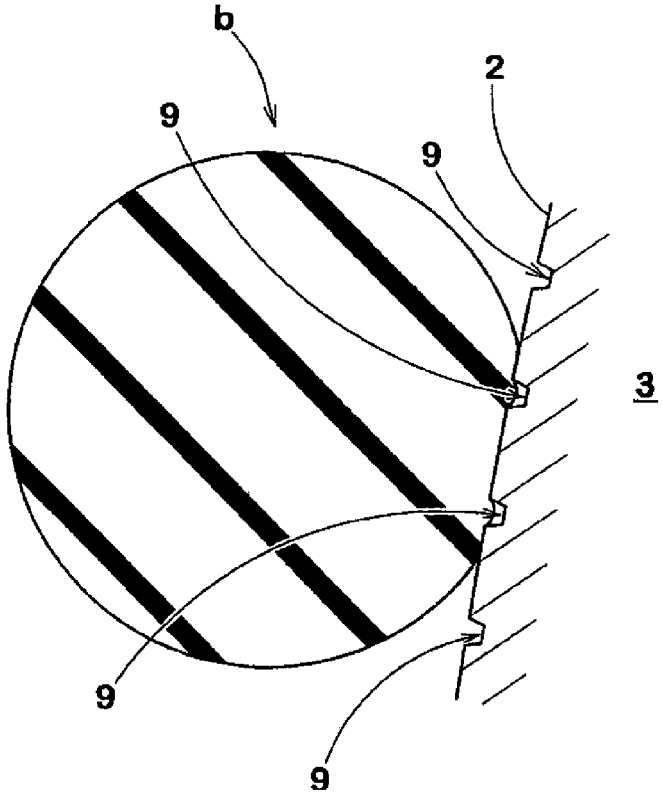
FIG. 10 is a diagrammatic cross sectional view showing the interface of a conventional clubface and a golf ball at impact.

If the sweet spot SS lies on one of the lateral zones 10 as shown in FIG. 7, it is necessary that at least the very same lateral zone, preferably together with two further lateral zones one on each side thereof, is provided with the convex curve. If the sweet spot SS lies within the width of one of the grooves 9 as shown in FIG. 8, it is necessary that at least two lateral zones one on each side of the same groove 9 are provided with the convex curve.

Preferably, at least the lateral zones which are located between the above-mentioned points Pu and Pd, are provided with the convex curve.

Further, in this embodiment, each of the lateral zones 10 is provided over the entire length thereof with the convex curve of the radius (r). But, it is also possible to provide the convex curve partially of the lateral zone 10, for example in a part within a center region Y as shown in FIG. 2. The center region Y is centered on the sweet spot SS in the toe-and-heel direction TH, wherein the width of the region Y is at least 20 mm, preferably at least 40 mm, more preferably 60 mm.

Furthermore, in this embodiment, all of the lateral zones 10 have the same radius (r). But, it is possible that the lateral zones 10 have two or more different radii (r). For example, the radius (r) can be gradually decreased as the distance from the sweet spot SS increases, whereby at the time of upper shots or lower shots, the frictional between the clubface and ball becomes smaller, and the vertical gear effect is further lessened.

The grooves 9 can be formed by means of machining by the use of a numerical control machine tool, press molding by the use of a punch marking die, or casting for example.

The curvature of the lateral zone 10 is formed by means of casting, forging or machining for example.

Comparison Tests

Wood-type golf club heads were prepared and tested for the backspin and carry distance.

All of the heads had same structures except for the radius (r) of curvature of the lateral zones. The specifications are shown in Table 1.

Each of the club heads was composed of an open-front hollow main body formed as a lost-wax precision casting of a titanium alloy Ti-6Al-4V, and a face plate formed by press molding a rolled sheet of the same titanium alloy. The face plate was placed at the front of the main body to cover the opening, and fixed thereto by means of plasma welding. Thus, the head had a two-piece structure. In order to provide different radii (r), different press dies were used in the process of press molding the rolled sheet. Specifications common to all of the heads are as follows:

Head volume: 460 cc
Head weight: 198 grams
Loft angle: 9.5 degrees
Clubface width FW: 105 mm
Clubface height h: 55 mm
Number of grooves 9: 8
Groove width: 0.70 mm
Groove depth: 0.20 mm
Intervals: 5.4 mm
Position of sweet spot: about 1 mm downward of the fourth groove from the crown
Thickness of Face portion: 3.3 mm at sweet spot, 2.5 mm in peripheral part The test methods are as follows:

Backspin and Carry Distance Test

The club heads were attached to identical FRP shafts to make 45-inche wood golf clubs. Each club was mounted on a swing robot and hits golf balls at a head speed of 45 m/s ten times at each of three positions: a position of the sweet spot (on-center shot); a position 8 mm above the sweet spot (upper shot); and a position 8 mm under the sweet spot (lower shot). With respect to each of the hitting positions, the average backspin and the average carry distance were obtained.

Such hitting test was carried out under both of a dry condition with both of the clubface and ball dried and a wet condition with both of the clubface and ball wetted.

The test results are shown in Table 1.

The present invention is suitably applied to wood-type golf club heads, but it is also possible to apply the present invention to various golf club heads such as of iron-type and utility-type as far as the clubface has a clubface roll and grooves.

TABLE 1

| Head | Ref. | Ex. 1 | Ex. 2 | Ex. 3 | Ex. 4 | Ex. 5 |
|---|---|---|---|---|---|---|
| Face roll R (mm) | 305 | 305 | 305 | 305 | 305 | 305 |
| Lateral zone | | | | | | |
| Radius r (mm) | 305 | 275 | 245 | 150 | 90 | 60 |
| r/R | 1 | 0.90 | 0.80 | 0.49 | 0.30 | 0.20 |
| Backspin (rpm) | | | | | | |
| Wet condition | | | | | | |
| Center shot (S3) | 2300 | 2320 | 2350 | 2420 | 2470 | 2490 |
| Dry condition | | | | | | |
| Center shot (S1) | 2700 | 2670 | 2640 | 2550 | 2490 | 2460 |
| Upper shot (U1) | 2200 | 2180 | 2160 | 2100 | 2070 | 2060 |
| Lower shot (D1) | 3200 | 3160 | 3120 | 3000 | 2910 | 2860 |
| D1 − U1 | 1000 | 980 | 960 | 900 | 840 | 800 |
| Carry distance (m) | | | | | | |
| Wet condition | | | | | | |
| Center shot (S4) | 242 | 242 | 244 | 246 | 247 | 248 |
| Dry condition | | | | | | |
| Center shot (S2) | 248 | 248 | 249 | 251 | 252 | 252 |
| Upper shot (U2) | 240 | 239 | 238 | 236 | 233 | 232 |
| Lower shot (D2) | 228 | 230 | 231 | 235 | 237 | 239 |
| Max. difference between U2, S2 and D2 | 20 | 18 | 18 | 16 | 19 | 20 |

The invention claimed is:

1. A golf club head comprising a face portion whose front face forms a clubface having a clubface roll of a radius R, the clubface provided with a plurality of parallel grooves extending straight at an angle of not more than 10 degrees with respect to a toe-and-heel direction of the head so as to form at least one lateral zone between said parallel grooves, wherein said at least one lateral zone is provided with a convex curve of a radius (r) smaller than the radius R of the clubface roll.

2. The golf club head according to claim 1, wherein said at least one lateral zone includes one lateral zone on which a sweet spot of the head is positioned.

3. The golf club head according to claim 1, wherein a sweet spot of the head is positioned within a width of one of the grooves, and said at least one lateral zone includes two lateral zones one on each side of said one of the parallel grooves.

4. The golf club head according to claim 1, wherein a ratio (r/R) of said radius (r) and radius R is in a range of from 0.30 to 0.80.

5. The golf club head according to claim 1, wherein said at least one lateral zone is a plurality of lateral zones existing between a position 10 mm downward of an upper edge of the clubface and a position 10 mm upward of a lower edge of the clubface in a vertical cross section including the sweet spot and the center of gravity of the head.

6. The golf club head according to claim 1, wherein the convex curve is provided in a region extending toward a toe and a heel of the head by at least 10 mm in the toe-and-heel direction from a sweet spot.

* * * * *